United States Patent [19]

Shiraishi et al.

[11] 4,425,100

[45] Jan. 10, 1984

[54] APPARATUS FOR MANUFACTURING A BULB

[75] Inventors: Isao Shiraishi, Yokosuka; Yukio Asou, Yokohama, both of Japan

[73] Assignee: Tokyo Shibaura Denki Kabushiki Kaisha, Kawasaki, Japan

[21] Appl. No.: 294,556

[22] Filed: Aug. 20, 1981

[30] Foreign Application Priority Data

Aug. 29, 1980 [JP] Japan ..... 55-119292

[51] Int. Cl.[3] ..... H01J 9/18

[52] U.S. Cl. ..... 445/67; 445/69

[58] Field of Search ..... 445/26, 27, 32, 67, 445/69; 65/139

[56] References Cited

U.S. PATENT DOCUMENTS

| | | | |
|---|---|---|---|
| 1,935,248 | 11/1933 | Malloy | 445/32 |
| 2,297,950 | 10/1942 | Flaws, Jr. | 140/71.6 |
| 2,824,356 | 2/1958 | Geissbuhler | 445/69 |
| 3,006,058 | 10/1961 | Goodwin et al. | 445/69 |
| 3,550,227 | 12/1970 | Weigel et al. | 445/67 |

*Primary Examiner*—Kenneth J. Ramsey

*Attorney, Agent, or Firm*—Cushman, Darby & Cushman

[57] ABSTRACT

An apparatus for manufacturing a bulb comprising a mount head including first and second pairs of lead-in wire holes alternately formed in a straight line, a first support mechanism capable of fixing in place lead-in wires inserted in the first pair of lead-in wire holes, and a second support mechanism capable of fixing in place lead-in wires inserted in the second pair of lead-in wire holes, a support mechanism for removably supporting the mount head in a predetermined position, an air cylinder for selectively driving the first and second mechanisms to fix the lead-in wires to predetermined positions relative to the mount head, locating plate on which one end of each lead-in wire inserted in each lead-in wire hole of the mount head abuts, whereby the position of one end relative to the mount head is defined, and an air cylinder capable of engaging the lead-in wires inserted in the first pair of lead-in wires to move the lead-in wires axially toward the mount head.

7 Claims, 15 Drawing Figures

APPARATUS FOR MANUFACTURING A BULB

BACKGROUND OF THE INVENTION

This invention relates to an apparatus for and method of manufacturing a bulb including pairs of lead-in wires arranged, in a straight line, respective paired lead-in wires supporting a pair of filaments and locating the filaments at substantially the same height.

For example, a semi-sealed lamp used as a head lamp of an automobile is composed of a reflector covered with a lens in front and a halogen lamp fitted in the reflector. Normally, the semi-sealed lamp is designed so as to be able to emit two beams, pass-by beam and running beam, so that the halogen lamp has a pair of filaments, one for pass-by beam and one for running beam, contained in its glass bulb.

Since the bulb wall temperature of the halogen lamp becomes extremely high when the lamp glows, high-melting-point glass such as silica glass is used for the bulb, and the sealed portion is pinch-sealed or flattened without using a flared glass stem which is used with a common incandescent lamp. In the halogen lamp, therefore, four lead-in wires connected with the filaments need be arranged in a straight line on a single sealing surface. Since the sealed beam lamp requires strict light distribution characteristic, the relative positions of the filaments in the bulb need be adjusted with high accuracy.

A conventional method for locating a pair of filaments at substantially the same height is as follows. First, two lead-in wires are fitted in a pair of lead-in wire holes formed in a single-connector mount head, and a filament coil is stretched between the tip ends of these lead-in wires to complete a desired mount, e.g. a mount for running beam. Then, after a mount for pass-by beam is manufactured in like manner, a double-conductor mount head having four lead-in wire holes arranged in a straight line is prepared. Then, the respective lead-in wires of the two mounts are transferred to this mount head so as to be located alternately. Thereafter, the lead-in wires are arranged in a straight line, and two filaments are located at substantially the same height.

However, the process for transferring the mounts separately manufactured on the single-conductor mount head to the double-conductor mount head depends largely on manual work, so that the working efficiency is too poor to enjoy mass production. Moreover, the manual work, which is low in reliability by nature, cannot ensure high-accuracy location of the filament coils, and is liable to cause variations in the mount shape.

SUMMARY OF THE INVENTION

The object of this invention is to provide an apparatus for and method of manufacturing a bulb capable of setting at least two filaments at the same height with high accuracy and improved in working efficiency to be be adapted to mass production.

In an aspect of this invention, there is provided an apparatus for manufacturing a bulb including a plurality of filaments and a plurality of pairs of lead-in wires arranged in a line to bear the filaments, each of these pairs of lead-in wires bearing one of the filaments, which comprises a main body, a mount head including at least first and second pairs of lead-in wire holes alternately formed in a straight line, a first support mechanism capable of fixing in place lead-in wires inserted in the first pair of lead-in wire holes, and a second support mechanism capable of fixing in place lead-in wires inserted in the second pair of lead-in wire holes, a support mechanism for removably supporting the mount head in a predetermined position of the main body, driving means for selectively driving the first and second mechanisms to fix the lead-in wires to predetermined positions relative to the mount head, locating means on which one end of each lead-in wire inserted in each of the lead-in wire holes of the mount head abuts, whereby the position of the one end relative to the mount head is defined, and operating means capable of engaging the lead-in wires inserted in the first pair of lead-in wires to move the lead-in wires axially toward the mount head.

In another aspect of the invention there is provided a method of manufacturing a bulb including a plurality of filaments and a plurality of pairs of lead-in wires, each bearing one of the filaments and supported by a sealed portion of the bulb, said method using a mount head having at least first and second pairs of lead-in wire holes alternately arranged for receiving the pairs of lead-in wires, first and second support mechanisms for detachably fixing in place the pairs of lead-in wires inserted respectively in the first and second pairs of lead-in wire holes and a hole for receiving an exhaust tube, comprising the steps of:

inserting a first pair of lead-in wires into the first pair of lead-in wire holes of said mount head until the forward ends of the first pair of lead-in wires extend from the first pair of lead-in wire holes for a predetermined distance;

connecting a first filament to the forward ends of the first pair of lead-in wires;

bending the first pair of lead-in wires in a predetermined direction;

pulling the forward end portions of the first pair of lead-in wires toward the mount head;

inserting a second pair of lead-in wires into the second pair of lead-in wire holes of said mount head until the forward ends of the second pair of lead-in wires extend from the second pair of lead-in wire holes and are spaced from the first filament in the axial direction of the lead-in wires;

connecting a second filament to the forward ends of the second pair of lead-in wires;

pulling the forward end portions of the first pair of lead-in wires away from the mount head until the first filament is positioned substantially flush with the second filament; and sealing the first and second pairs of lead-in wires at one end portion of the bulb.

According to the above-mentioned manufacturing apparatus, determination of the lengths of the led out portions of the lead-in wires, fixation of these lead-in wires, and location or alignment of the filaments can automatically be performed in succession, providing facility for the automatic assembly of the bulb. Especially, automatic attachment and detachment of the mount head will enable integral manufacture of lamps or lamp bulbs without requiring any manual operation, leading to a reduction of labor in the manufacture of lamps.

The first pair of lead-in wires may be aligned ahead of or after the second pair of lead-in wires. Thus, the sequence of the mount manufacture may be suitably established according to the type of the bulb to be manufactured. This leads to an improvement in working efficiency.

BRIEF DESCRIPTION OF THE DRAWINGS

FIGS. 1 to 3 show a mount head of an apparatus for manufacturing a bulb according to an embodiment of this invention, in which FIG. 1 is a perspective view, FIG. 2 is a sectional view, and FIG. 3 is a front view;

DETAILED DESCRIPTION OF THE PREFERRED EMBODIMENT

Now there will be described an embodiment of this invention with reference to the accompanying drawings.

Figure 1:
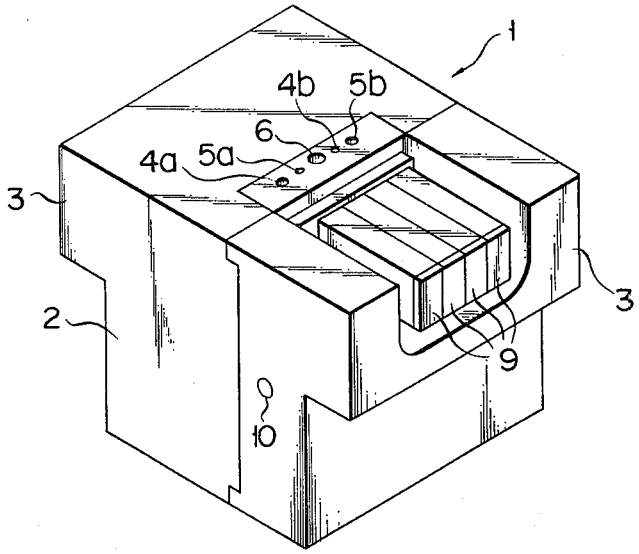
Figure 2:
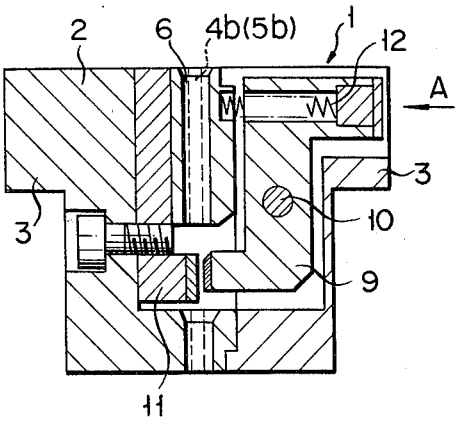
Figure 3:
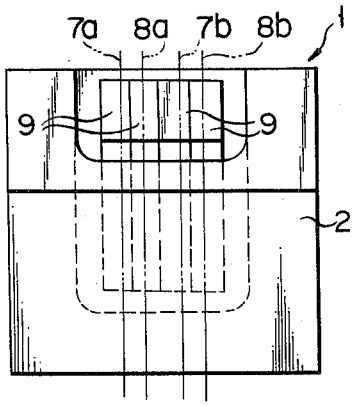
Figure 4A:
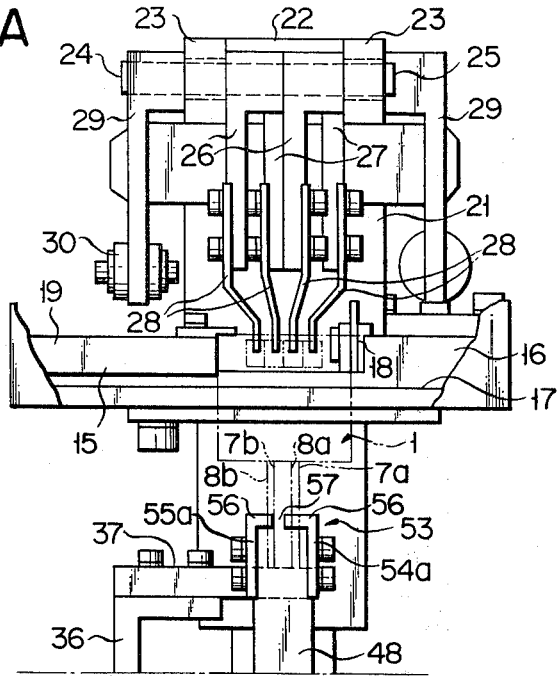
FIGS. 4A and 4B are partially broken away, front views separately showing upper and lower portions of the apparatus, respectively.

Referring now to FIGS. 1 to 3, there is shown a mount head 1 which includes a head body 2 with a pair of hook portions 3 bilaterally projected from the upper side portions thereof. Four lead-in wire holes 4*a*, 4*b*, 5*a* and 5*b* are vertically formed through the head body 2 and arranged along a straight line on the top surface of the head body 2, and an exhaust tube fitting hole 6 is formed between the lead-in wire holes 4*b* and 5*a*. Four chuck claws 9 for removably fixing lead-in wires 7*a*, 7*b*, 8*a* and 8*b* to be inserted in the lead-in wire holes 4*a*, 4*b*, 5*a* and 5*b* are attached to those portions of the head body 2 which correspond to the holes 4*a*, 4*b*, 5*a* and 5*b*. These chuck claws 9 are rockably mounted on the head body 2 by means of a common pivot 10. The upper projected ends of the chuck claws 9 are exposed in an opening defined in one of the hook portions 3 of the head body 2, while the lower projected ends are located at the middle portions of the lead-in wire holes opposite to a common flat pressure surface 11 which faces the middle portions of the lead-in wire holes 4*a*, 4*b*, 5*a* and 5*b*. The chuck claws 9 are urged to rock in a direction to abut against the pressure surface 11 at their lower projected ends by compression coil springs 12 interposed between the chuck claws 9 and the side surface of the opening formed in the head body 2. Thus, the lead-in wires 7*a*, 7*b*, 8*a* and 8*b* are separately held and fixed between the lower projected ends of the chuck claws 9 and the pressure surface 11. The lead-in wire can be released from such fixation by depressing the upper projected end of the chuck claw 9 in the direction of an arrow A of FIG. 2 against the urging force of the compression coil spring 12.

Figure 6:
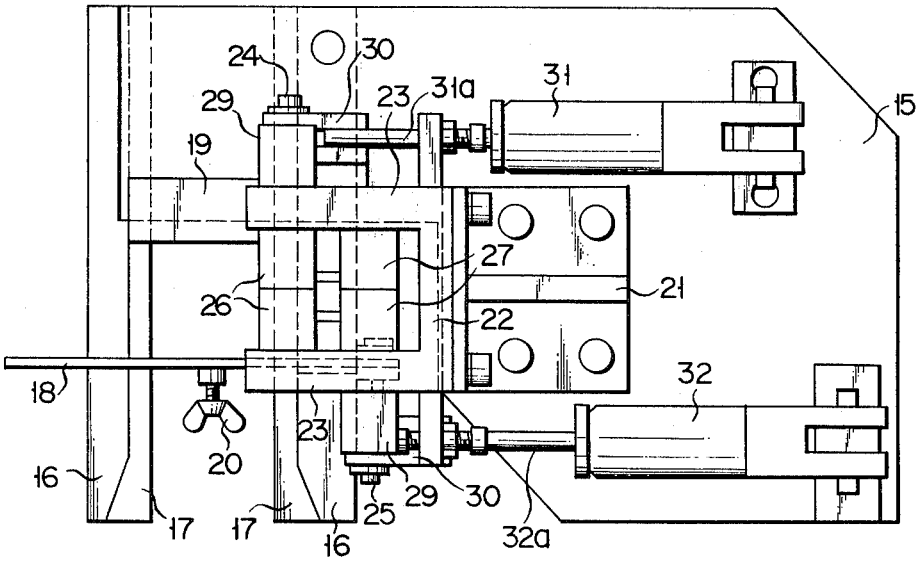
FIG. 6 is a top view of the apparatus.
Figure 4B:
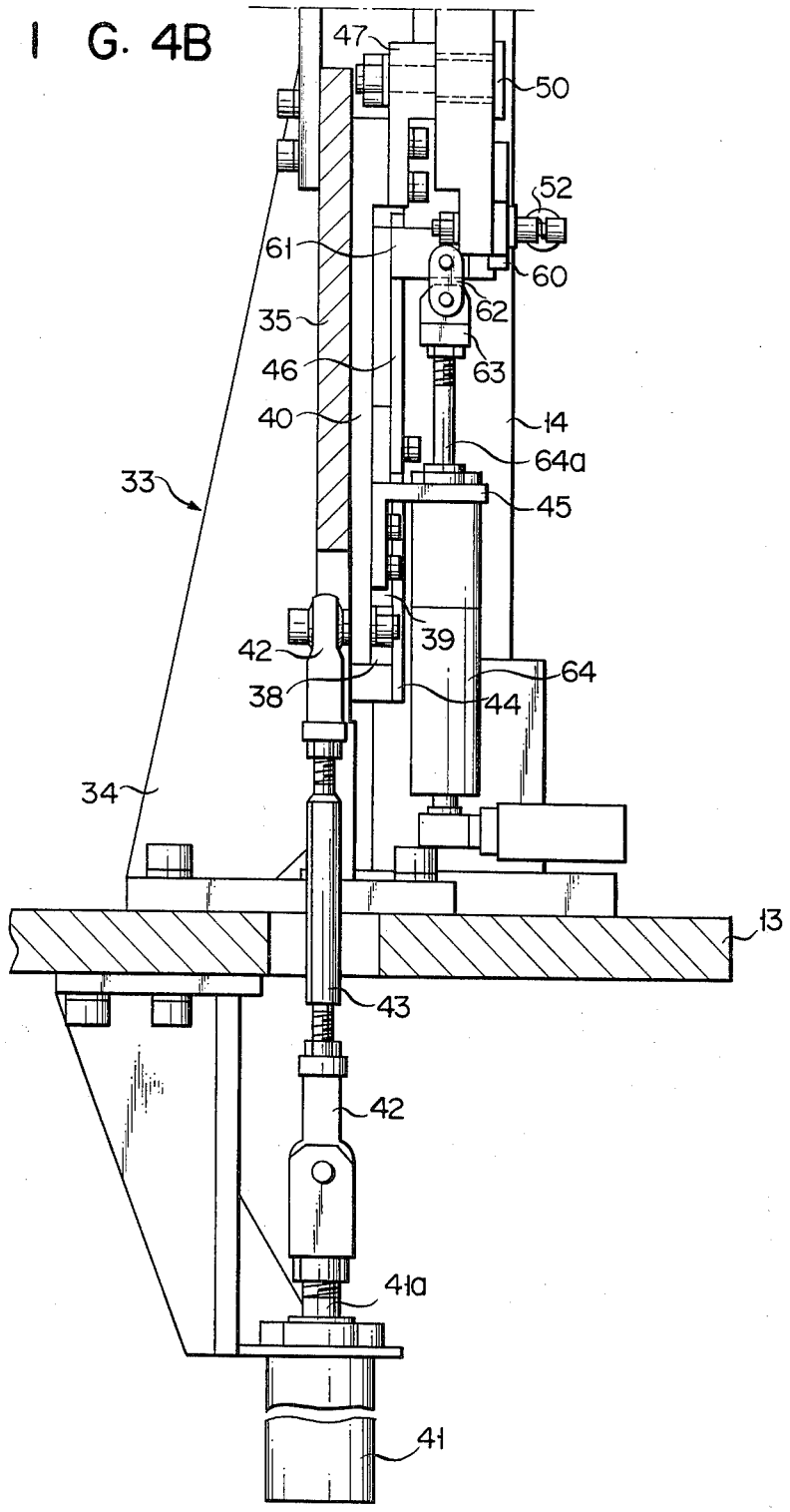
Figure 5A:
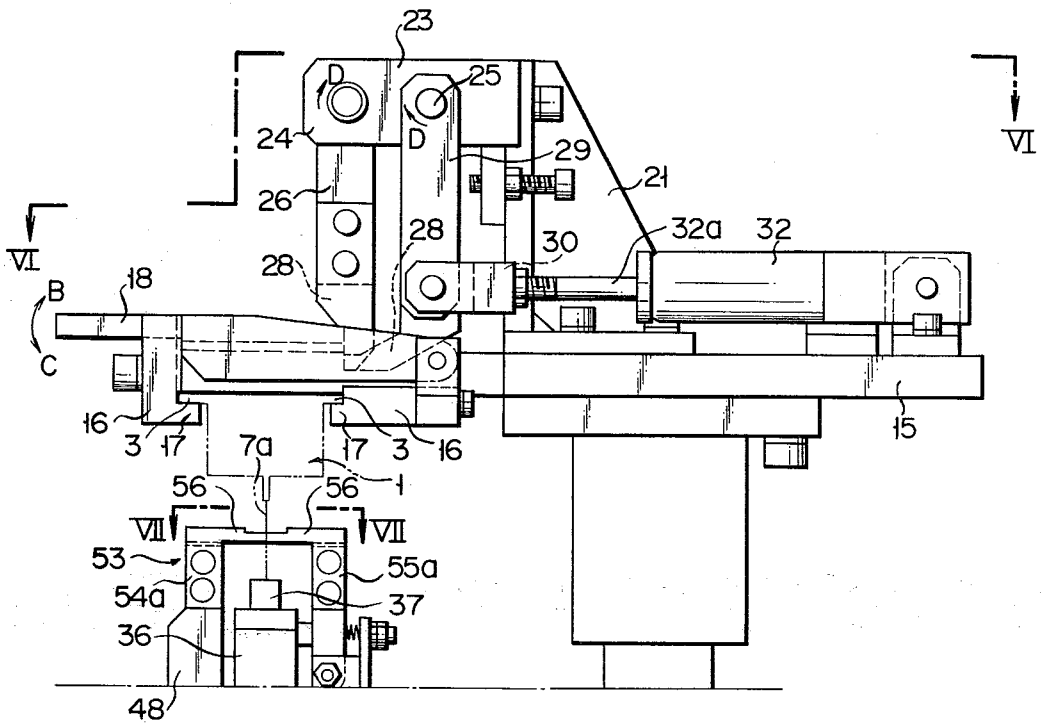
FIGS. 5A and 5B are partially broken away, side views separately showing the upper and lower portions of the apparatus, respectively.
Figure 5B:
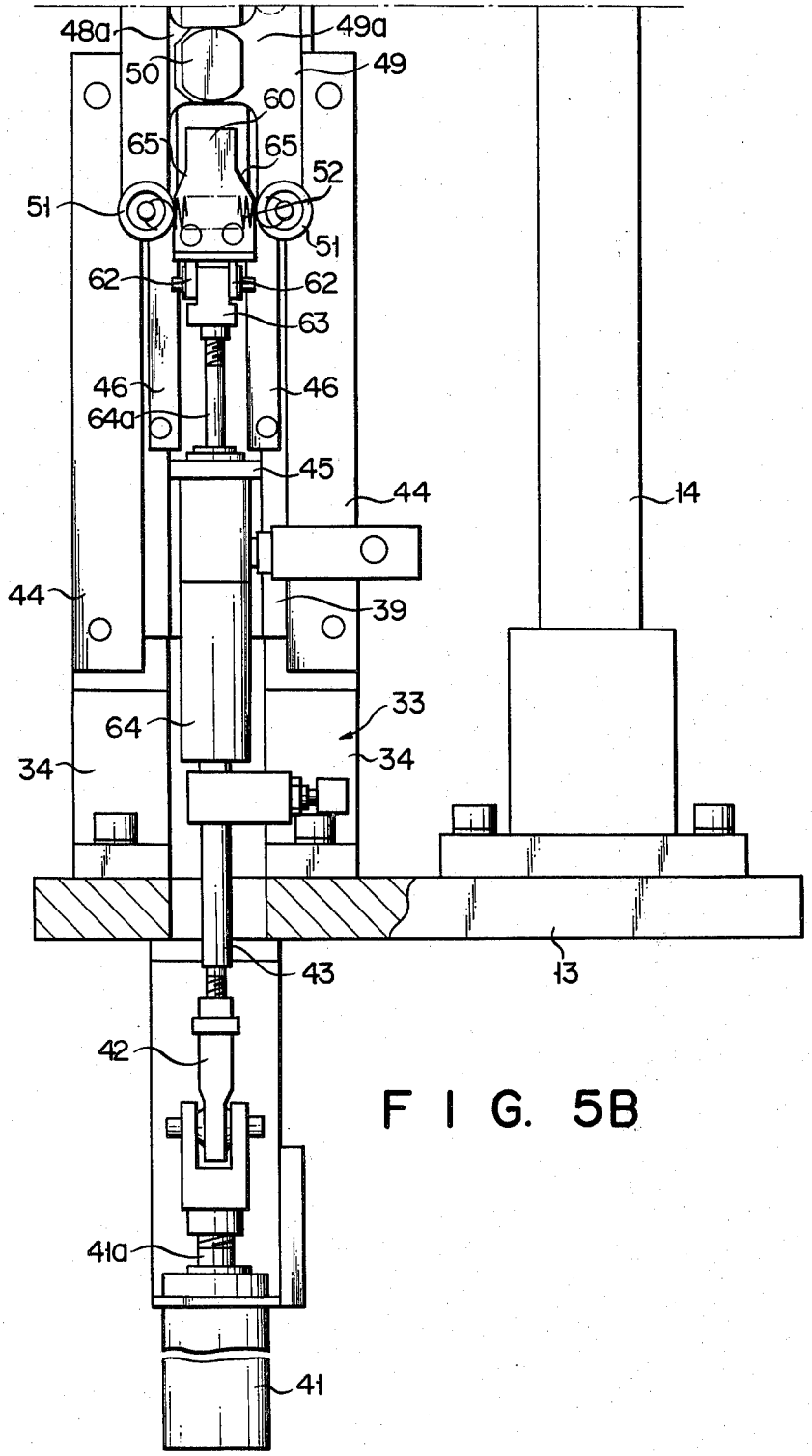

In FIGS. 4A, 4B, 5A, 5B to FIG. 7, numeral 13 designates a chassis, and a support plate 15 is horizontally mounted on the upper end portion of a support 14 vertically extending upward from the chassis 13. As shown in FIG. 6, a pair of rails 16 are mounted on one side edge portion of the support plate 15, and horizontally extended to face each other at a space. The hook portions 3 of the mount head 1 are to be sustained by flange portions 17 on the lower edges of the facing surfaces of the rails 16. On one side edge portion, moreover, a fixing plate 18 capable of rocking in the directions of arrows B and C of FIG. 5A lies astride the rails 16. The fixing plate 18 is intended to fix the mount head 1 to a predetermined position on the rails 16. In fixing the mount head 1 on the rails 16, the mount head 1 is first inserted between the rails 16 with the fixing plate 18 rocked in the direction of the arrow B. When one side face of the head body 2 abuts against a stopper member 19 of the support plate 15, the fixing plate 18 is rocked in the direction of the arrow C, and a thumbscrew 20 on the fixing plate 18 is screwed in so that the forward end of the screw 20 presses the one side face of the head body 2 against the stopper member 19 to fix the mount head 1 to the predetermined position. A U-shaped support member 22 is fixed on the support plate 15 by means of a bracket 21. The support member 22 is located diagonally above the mount head 1. Two rocking shafts 24 and 25 extend in parallel across two facing support arms 23 of the support member 22. The rocking shafts 24 and 25 are fitted with pairs of rocking arms 26 and 27 alternately extending downward, and control claws 28 are attached to the extended end portions of the rocking arms 26 and 27. The tip ends of the control claws 28 face the upper projected ends of the chuck claws 9 of the mount head 1. One end portions of the rocking shafts 24 and 25 are projected in opposite directions from their corresponding support arms 23, and one of the ends of control levers 29 is detachably fixed to the projected portions of the rocking shafts 24 and 25. Piston rods 31*a* and 32*a* of first and second air cylinders 31 and 32 are severally coupled to the other ends of the control levers 29 by means of joints 30. When the air cylinders 31 and 32 are operated so as to project the piston rods 31*a* and 32*a*, the rocking shats 24 and 25 are rocked in the direction of arrows D of FIG. 5A by means of the control levers 29, so that the forward ends of the control claws 28 are advanced to push the upper projected ends of the chuck claws 9 into the head body 2 against the urging force of the compression coil springs 12.

A support block 33 is fixed on the top of the chassis 13. A locating plate 37 is supported by means of an L-shaped stay 36 in the center of the upper portion of a web member 35 coupling two flange portions 34 of the support block 33 so that the top surface of the locating plate 37 is kept horizontal. The locating plate 37 faces the under surface of the fixed mount head 1 at a given distance therefrom so that the front ends of the lead-in wires 7*a*, 7*b*, 8*a* and 8*b* passed through the holes 4*a*, 4*b*, 5*a* and 5*b* may abut against the top surface of the locating plate 37. The support block 33 is fixedly fitted with a guide plate 39 with a vertically extending guide groove 38, and a slide plate 40 capable of ascent and descent is guided in the guide groove 38. The slide plate 40 is coupled to a piston rod 41*a* of a third air cylinder 41 by means of a driving rod 42 and a rod end joint 43. Numeral 44 designates a support plate which is fixed to the guide plate 39 to support the slide plate 40 and to guide the plate 40 in its vertical movement. A bracket 45 is attached to the lower side of the slide plate 40, and stopper plates 46 on which the upper edge of the bracket 45 abuts when the slide plate 40 is raised are fixed to both side edge portions of the guide groove 38 of the guide plate 39. A fitting member 47 is fixed to the upper portion of the slide plate 40, and a pair of chuck supporting structures 48 and 49 are attached to the fitting member 47. These chuck supporting structures 48 and 49 are pivotally mounted so as to be able to rock along a direction perpendicular to the array of the lead-in wires 7*a*, 7*b*, 8*a* and 8*b*, with a coupling bolt 50 in the fitting member 47 inserted in coupling piece sections 48*a* and 49*a* in the middle of the chuck supporting structures 48 and 49, and are allowed to move in directions in which the upper and lower end portions of the chuck supporting structures 48 and 49 come close to and are separated from each other. A bearing 51 is disposed at each of the lower end portions of the chuck supporting structures 48 and 49, and a tension coil spring 52 is stretched between these lower end portions.

Figure 7:
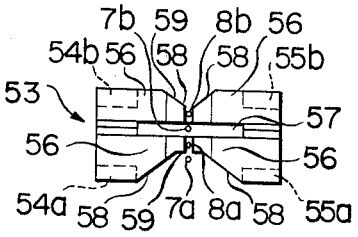
FIG. 7 is a top view of a chuck mechanism.

A chuck mechanism 53 is mounted on the upper end portions of the chuck supporting structures 48, 49, lying between the mount head 1 and the locating plate 37. In this chuck mechanism 53, a pair of substantially L-shaped pinch claws 54*a* and 54*b* and another pair 55*a* and 55*b* are removably mounted on both sides of the chuck supporting structures 48 and 49, respectively. As shown in FIG. 7, claw portions 56 of these pinch claws 54*a*, 54*b*, 55*a* and 55*b* are different in width. Defined between the pinch claws 54*a*, 54*b*, 55*a* and 55*b* is a gap 57 which extends along a direction perpendicular to the direction in which the lead-in wires 7*a*, 7*b*, 8*a* and 8*b* are arranged. The gap 57 is biased to one side from the center of the array of the lead-in wires 7*a*, 7*b*, 8*a* and 8*b* so that only the lead-in wire 7*b* can be inserted in the gap 57. The facing outside edges of the pinch claws 54*a*, 54*b*, 55*a* and 55*b* form notch portions 58, which are to form substantially V-shaped escape portions 59 when the forward end faces of the claw portions 56 of the pinch claws 54*a* and 55*a* and the pinch claws 54*b* and 55*b* abut against one another. The lead-in wire 7*a* is passed through the escape portion 59 formed on the side of the pinch claws 54*a* and 55*a*. In this embodiment, therefore, the lead-in wires 8*a* and 8*b* are held by the pinch claws 54*a* and 55*a* and the pinch claws 54*b* and 55*b*, respectively. When the pinch claws 54*a*, 54*b*, 55*a* and 55*b* are removed and attached to the chuck supporting structures 48 and 49 on the opposite sides, the lead-in wires 7*a* and 7*b* are held by the pinch claws 54*b* and 55*b*, and the lead-in wires 8*a* and 8*b* are passed through the gap 57 and the escape portion 59, respectively.

Meanwhile, an operator 60 for opening and closing the chuck mechanism 53 is interposed between the respective bearings 51 of the chuck supporting structures 48 and 49. The operator 60 is attached to a fixed bracket 61 guided so as to be able to ascent and descent between the stopper plates 46, and the fixed bracket 61 is coupled by means of links 62 and a joint 63 to a piston rod 64*a* of a fourth air cylinder 64 attached to the bracket 45. The bearings 51 are in rolling contact with both side faces of the operator 60, and slanting surfaces 65 inclined so as to reduce the space between the two side faces are formed at the upper portions of the side faces. Accordingly, when the fourth air cylinder 64 is operated so as to project the piston rod 64*a*, the bearings 51 are brought into rolling contact with the lower side faces of the operator 60 to move the chuck supporting structures 48 and 49 in the directions to separate the upper and lower end portions of the chuck supporting structures 48 and 49. Thus, the chuck mechanism 53 is closed, that is, the forward end faces of the pinch claws 54*a* and 55*a* and the pinch claws 54*b* and 55*b* are caused to abut against one another. When the piston rod 64*a* is withdrawn, on the other hand, the bearings 51 roll upward on the two side faces of the operator 60 to come in rolling contact with the slanting surfaces 65. Accompanying such rolling contact, the chuck supporting structures 48 and 49 are rocked by the urging force of the tension coil spring 52 in directions to separate their upper end portions, and the pinch claws 54*a* and 54*b* are released from the abutment against the pinch claws 55*a* and 55*b*, that is, the chuck mechanism 53 is opened.

Figure 8A:
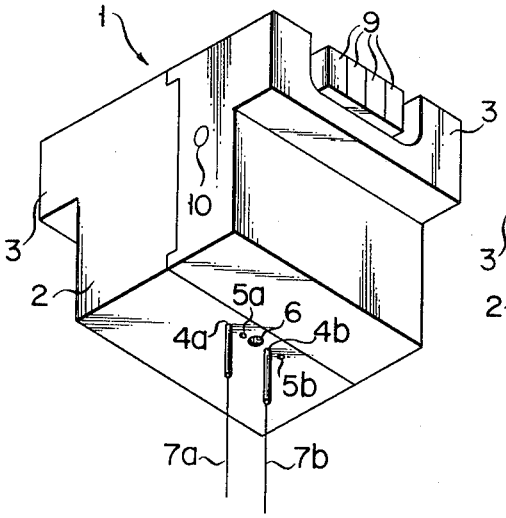
FIGS. 8A to 8F are schedule diagrams for illustrating a method for manufacturing a bulb by using the apparatus.
Figure 8B:
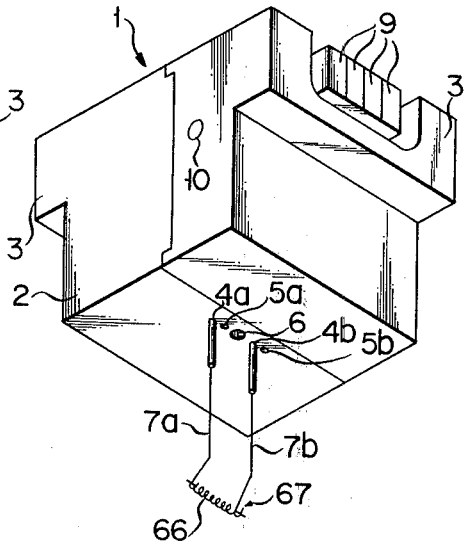

Referring also to FIGS. 8A to 8F, there will be described a method for manufacturing a halogen lamp by the use of the manufacturing apparatus constructed in the above-mentioned manner. First, the mount head 1 is fixed to the predetermined position on the rails 16, and the piston rod 32*a* of the second air cylinder 32 is projected to open the chuck claws 9 corresponding to the lead-in wire holes 4*a* and 4*b*. At the same time, the piston rod 64*a* of the fourth air cylinder 64 is withdrawn to bring the bearings 51 of the chuck supporting structures 48 and 49 into rolling contact with the slanting surfaces 65 of the operator 60, thereby separating the pinch claws 54*a* and 54*b* respectively from the pinch claws 55*a* and 55*b*, that is, opening the chuck mechanism 53. Then, as shown in FIG. 8A, the lead-in wires 7*a* and 7*b* are inserted into the lead-in wire holes 4*a* and 4*b* from the top opening portions thereof. When the inserted forward ends of the lead-in wires 7*a* and 7*b* abut against the top surface of the locating plate 37, the piston rod 32*a* is withdrawn to hold and fix the lead-in wires 7*a* and 7*b* in the mount head 1 by means of the chuck claws 9 and the pressure surface 11. In this case, the forward end portions of the lead-in wires 7*a* and 7*b* are led out of the under surface of the mount head 1 through a given length. Then, the mount head 1 is transferred from the rails 16 to a mount making apparatus (not shown). Thereupon, a filament 66 for e.g. pass-by beam is bridged between the forward ends of the lead-in wires 7*a* and 7*b* led out of the mount head 1, and then the led out portions of the lead-in wires 7*a* and 7*b* are bent in the middle in a predetermined direction to produce a mount 67 for pass-by beam as shown in FIG. 8B.

Figure 8C:
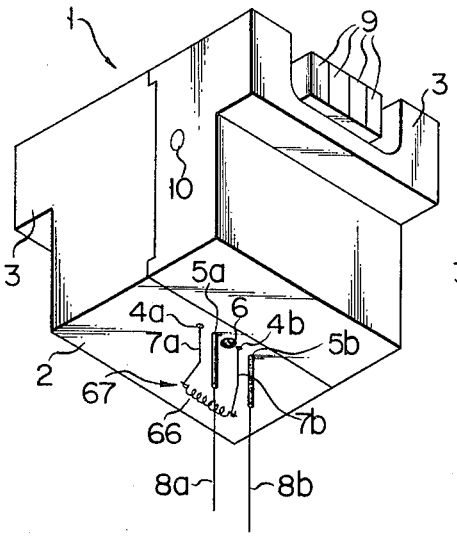

Subsequently, the mount head 1 is transferred from the mount making apparatus to the predetermined position on the rails 16, and then the first air cylinder 31 is operated so as to project the piston rod 31*a*, thereby opening the chuck claws 9 corresponding to the remaining lead-in holes 5*a* and 5*b*. Then, the lead-in wires 8*a* and 8*b* are inserted into the lead-in wire holes 5*a* and 5*b* from the top opening portions thereof. When the inserted forward ends of the lead-in wires 8*a* and 8*b* abut against the top surface of the locating plate 37, the piston rod 31*a* is withdrawn to hold and fix the lead-in wires 8*a* and 8*b* in the mount head 1 by means of the chuck claws 9 and the pressure surface 11. At the same time, the pinch claws 54*a* and 54*b* are caused to abut respectively against the pinch claws 55*a* and 55*b* to close the chuck mechanism 53 by projecting the piston rod 64*a* of the fourth air cylinder 64, and thus the led out portions of the lead-in wires 7*a* and 7*b* of the mount 67 for pass-by beam are pinched and fixed. In this case, the led out portions of the lead-in wires 8*a* and 8*b* are passed through the gap 57 and the escape portion 59 of the chuck mechanism 53, and are not held by the chuck mechanism 53 at all. Thereafter, the piston rod 32*a* of the second air cylinder 32 is projected to open the chuck claws 9, thereby releasing the lead-in wires 7*a* and 7*b* of the mount 67 from the fixation. At the same time, the piston rod 41*a* of the third air cylinder 41 is projected to raise the chuck mechanism 53 fixing the lead-in wires 7*a* and 7*b* to the side of the mount head 1 by means of the slide plate 40 and the chuck supporting structures 48 and 49. Thus, as shown in FIG. 8C, the filament 66 of the mount 67 is moved closer to the mount head side than to the inserted forward ends of the lead-in wires 8*a* and 8*b*. In this state, the piston rod 32*a* of the second air cylinder 32 is withdrawn again to hold and fix the lead-in wires 7*a* and 7*b* of the mount 67.

Figure 8D:
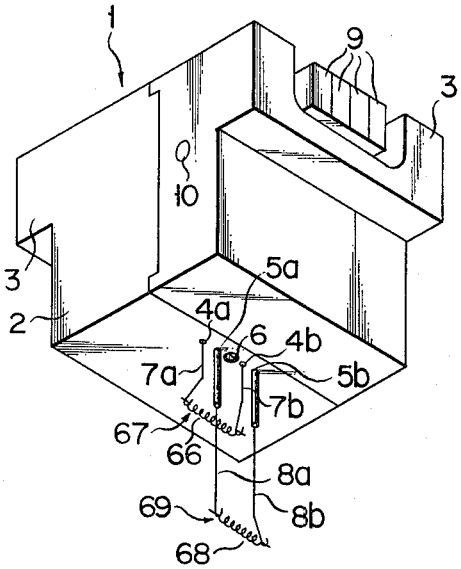
Figure 8E:
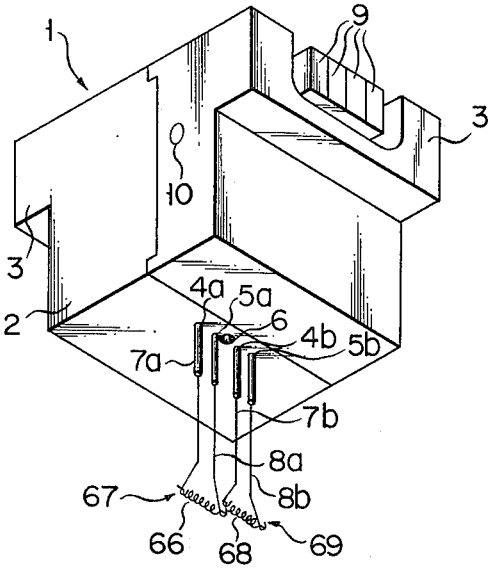
Figure 8F:
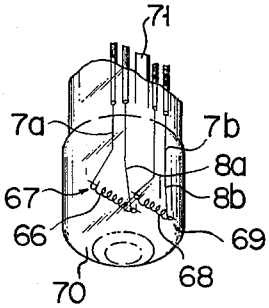

Subsequently, after the chuck mechanism 53 is opened, the mount head 1 is removed again from the rails 16, and set in the mount making apparatus. Thereupon, a filament 68 for running beam is bridged between the led out forward end portions of the lead-in wires 8*a* and 8*b*, and then the led out portions of the lead-in wires 8*a* and 8*b* are bent in the middle at a given angle in the opposite direction to the direction in which the lead-in wires 7*a* and 7*b* of the mount 67 are bent. Thus obtained is a mount 69 for running beam as shown in FIG. 8D. Thereafter, the mount head 1 is again transferred from the mount making apparatus to the predetermined position on the rails 16. By closing the chuck mechanism 53, the lead-in wires 7*a* and 7*b* of the mount 67 for pass-by beam are held and fixed between the pinch claws 54*a* and 55*a* and between the pinch claws 54*b* and 55*b*, respectively. Subsequently, when the piston rod 41*a* of the third air cylinder 41 is withdrawn, the chuck mechanism 53 is lowered by means of the slide plate 40, the mount 67 shifted to the head side is restored to its original position, and the filaments 66 and 68 for pass-by and running beams are located so as to be substantially flush with each other, as shown in FIG. 8E. Thereafter, the mounts 67 and 69 are enclosed with a bulb 70, and an exhaust tube 71 is inserted into the bulb 70 through the fitting hole 6 of the head 1. Then, the opening portion of 30 pinch claws alternatively to the chuck supporting structures 48 and 49 on the opposite sides, so that the sequence of manufacture of the mounts 67 and 69 can be established freely.

This invention is not limited to the above-mentioned embodiment. In the above embodiment, for example, the lead-in wires of both mounts are bent in opposite directions after they are fitted with the filaments. However, if the bending angle of the lead-in wires of one of the mounts manufactured earlier is made greater, the lead-in wires or the other mount need not always be bent.

Further, the apparatus according to this invention is not limited to the manufacture of halogen lamps for head lamps of automobiles, and may also be applied to the manufacture of, for example, turn signal lamps and dashboard lighting of automobiles and lamps used in any other equipments than automobiles, that is, any lamps in which a pair of filaments are arranged at substantially equal heights in a bulb.

In the above embodiment, the apparatus for manufacturing a bulb according to the invention has been explained as an apparatus for manufacturing a halogen lamp which is provided with a filament for pass-by beam and a filament for running beam. The invention may, however, be applied to any apparatus for manufacturing lamps in which at least two pairs of lead-in wires are arranged in a line.

What we claim is:

1. An apparatus for manufacturing a bulb including a fixing those portions of the lead-in wires which are located inside the lead-in wire holes.

4. An apparatus for manufacturing a bulb according to claim 3, wherein said locating means includes a locating plate disposed at a given distance from the under surface of said mount head so that the lower ends of the lead-in wires may abut on said locating plate.

5. An apparatus for manufacturing a bulb according to claim 4, wherein said operating means includes a chuck means for pinching those portions of the lead-in wires which extend between said mount head and said locating plate, and a driving mechanism for vertically moving said chuck mechanism.

6. An apparatus for manufacturing a bulb according to claim 5, wherein the chuck means of said operating means includes two pairs of pinch claws for pinching said first pair of lead-in wires and a notch portion formed on one of said two pairs of pinch claws so that one of said second pair of lead-in wires may be loosely passed through said notch portion, a gap through which the other of said second pair of lead-in wires is to be loosely passed being defined between said two pairs of pinch claws.

7. A method of manufacturing a bulb including a plurality of filaments and a plurality of pairs of lead-in wires, each bearing one of the filaments and supported by a sealed portion of the bulb, said method using a mount head having at least first and second pairs of lead-in wire holes alternately arranged for receiving the pairs of lead-in wires, first and second support mechanisms for detachably fixing in place the pairs of lead-in wires inserted respectively in the first and second pairs of lead-in wire holes and a hole for receiving an exhaust tube, comprising the steps of:

inserting a first pair of lead-in wires into the first pair of lead-in wire holes of said mount head until the forward ends of the first pair of lead-in wires extend from the first pair of lead-in wire holes for a predetermined distance;

connecting a first filament to the forward ends of the first pair of lead-in wires;

bending the first pair of lead-in wires in a predetermined direction;

pulling the forward end portions of the first pair of lead-in wires toward the mount head;

inserting a second pair of lead-in wires into the second pair of lead-in wire holes of said mount head until the forward ends of the second pair of lead-in wires extend from the second pair of lead-in wire holes and are spaced from the first filament in the axial direction of the lead-in wires;

connecting a second filament to the forward ends of the second pair of lead-in wires;

pulling the forward end portions of the first pair of lead-in wires away from the mount head until the first filament is positioned substantially flush with the second filament; and sealing the first and second pairs of lead-in wires at one end portion of the bulb.

* * * * *